United States Patent [19]

Jennings, Jr. et al.

[11] Patent Number: 5,005,645

[45] Date of Patent: Apr. 9, 1991

[54] METHOD FOR ENHANCING HEAVY OIL PRODUCTION USING HYDRAULIC FRACTURING

[75] Inventors: Alfred R. Jennings, Jr., Plano; Roger C. Smith, Dallas, both of Tex.

[73] Assignee: Mobil Oil Corporation, Fairfax, Va.

[21] Appl. No.: 446,835

[22] Filed: Dec. 6, 1989

[51] Int. Cl.[5] ..... E21B 43/267; E21B 33/134

[52] U.S. Cl. ..... 166/280; 166/281; 166/303; 166/308

[58] Field of Search ..... 166/280, 281, 283, 303, 166/308, 271, 272, 274, 275

[56] References Cited

U.S. PATENT DOCUMENTS

| | | | |
|---|---|---|---|
| 3,259,186 | 7/1966 | Dietz . | |
| 3,280,909 | 10/1966 | Closmann et al. . | |
| 3,354,954 | 11/1967 | Buxton . | |
| 3,367,419 | 2/1968 | Van Lookeren . | |
| 4,067,389 | 1/1978 | Savins | 166/246 |
| 4,109,722 | 8/1978 | Widmyer | 166/263 X |
| 4,109,723 | 8/1978 | Widmyer | 166/263 X |
| 4,378,845 | 4/1983 | Medlin et al. | 166/278 X |
| 4,378,849 | 4/1983 | Wilks | 166/369 |
| 4,549,608 | 10/1985 | Stowe et al. | 166/280 |
| 4,623,021 | 11/1986 | Stowe | 166/281 X |
| 4,848,468 | 7/1989 | Hazlett et al. | 166/300 |

*Primary Examiner*—George A. Suchfield

*Attorney, Agent, or Firm*—Alexander J. McKillop; Charles J. Speciale; Charles A. Malone

[57] ABSTRACT

A method for controlling the production of formation fines during the production of heavy oils from a sandstone formation. Hydraulic fracturing is conducted in an interval of the formation using a viscous gel fracturing fluid having a proppant therein. The proppant is sized based on the particle size distribution of the formation fines so as to restrict formation fines movement into the propped fracture. Thereafter, intermittent steam injection is conducted in the formation's productive interval. Hydrocarbon production from the formation is controlled so as to allow formation fines build-up on the fracture face thereby improving the filtration of fines from the heavy oil. After removing a desired amount of hydrocarbonaceous fluids from this productive interval, it is mechanically isolated. Thereafter, the steps are repeated in another productive interval.

6 Claims, 2 Drawing Sheets

METHOD FOR ENHANCING HEAVY OIL PRODUCTION USING HYDRAULIC FRACTURING

FIELD OF THE INVENTION

This invention relates to a process for extracting hydrocarbons from the earth. More particularly, this invention relates to a method for recovering especially solids-free hydrocarbons e.g., bitumen from a subterranean formation using at least one well.

BACKGROUND OF THE INVENTION

In many areas of the world, there are large deposits of viscous petroleum, such as the Athabasca and Peace River regions in Canada, the Jobo region in Venezuela and the Edna and Sisquoc regions in California. These deposits are generally called tar sand deposits due to the high viscosity of the hydrocarbons which they contain. These deposits may extend for many miles and occur in varying thickness of up to more than 300 feet. Although tar sands may lie at or near the earth's surface, generally they are located under substantial overburden which may be as great as several thousand feet thick. Tar sands located at these depths constitute some of the world's largest presently known petroleum deposits.

Tar sands contain a viscous hydrocarbon material, commonly referred to as bitumen, in an amount which ranges from about 5 to about 20 percent by weight. Bitumen is usually immobile at typical reservoir temperatures. For example, at reservoir temperatures of about 48° F., bitumen is immobile, having a viscosity frequently exceeding several thousand poises. At higher temperatures, such as temperatures exceeding 200° F., bitumen generally becomes mobile with a viscosity of less than 345 centipoises.

Since most tar sand deposits are too deep to be mined economically, a serious need exists for an in situ recovery process wherein the bitumen is separated from the sand in the formation and recovered through production means e.g. a well drilled into the deposit. In situ recovery processes known in the art include emulsification drive processes, thermal techniques (such as fire flooding), is situ combustion, steam flooding and combinations of these processes.

Any in situ recovery process must accomplish two functions. First, the viscosity of the bitumen must be reduced to a sufficiently low level to fluidize the bitumen under the prevailing conditions. Secondly, sufficient driving energy must be applied to treated bitumen thereby inducing it to move through the formation to a well or other means for transporting it to the earth's surface.

As previously noted, among the various methods that have been proposed for recovering bitumen in tar sand deposits are heating techniques. Because steam is generally the most economical and efficient thermal energy agent, it is clearly the most widely employed.

Several steam injection processes have been suggested for heating the bitumen. One method involves a steam stimulation technique, commonly called the "huff and puff" process. In such a process, steam is injected into a well for a certain period of time. The well is then shut in to permit the steam to heat the oil. Subsequently, formation fluids, including bitumen, water and steam, are produced from the well along with sand. Production is later terminated and steam injection is preferably resumed for a further period. Steam injection and production are alternated for as many cycles as desired. A principle drawback to the "huff and puff" technique is that it does not heat the bulk of the oil in the reservoir and consequently reduces the oil recovery.

Another problem with steam drive is that the driving force of the steam flooding technique is ultimately lost when breakthrough occurs at the production well. Steam breakthrough occurs when the steam front advances to a production well and steam pressure is largely dissipated through the production well. Fluid breakthrough causes a loss of steam driving pressure characterized by a marked diminution in the efficiency of the process. After steam breakthrough the usual practice, as suggested in U.S. Pat. No. 3,367,419 (Lookeren) and U.S. Pat. No. 3,354,954 (Buxton), is to produce without steam drive until further steam injection is necessitated or production terminated. These patents are incorporated herein by reference.

U.S. Pat. No. 3,259,186 (Dietz), for example, appears to have an early teaching for conventional "huff and puff". The patent discloses a method for recovering viscous oil from subterranean formations by simultaneously injecting steam into an injection well to heat the formation. Formation fluids are then produced from the injection well. After several cycles, steam drive can be established if several adjacent injection wells have been used by injecting steam into one injection well while using another for production. U.S. Pat. No. 3,280,909 (Closmann et al) discloses a conventional steam drive comprising steam injection to produce interconnecting fractures, but insufficient to produce oil, followed by steam drive at conventional pressures and rates. Thus, the heating and driving phases are entirely distinct. These patents are incorporated herein by reference.

Steam also releases unconsolidated formation sand grains as it lowers the viscosity of the formation oil. Formation oil, thus released, will be free to move with the oil of reduced viscosity as the formation is produced.

Therefore, what is needed is an efficient method to produce an unconsolidated or loosely consolidated formation, control formation fines, and still allow steam contact with oil in place in the formation.

SUMMARY OF THE INVENTION

This invention is directed to a method for producing viscous substantially solids-free hydrocarbonaceous fluids from an unconsolidated or loosely consolidated formation or reservoir. Initially, at least one well is drilled into a lower productive interval of the formation. Afterwards, the well is hydraulically fractured with a fracturing fluid containing a proppant so as to create and prop fractures in the formation's lower interval. Thereafter, a pre-determined volume of steam is injected into the well in an amount sufficient to soften the viscous fluid and reduce the viscosity of said fluid adjacent to a fracture face. The well is then produced at a rate sufficient to allow formation fines to build up on the propped fracture face communicating with said well, thereby, resulting in a filter which is sufficient to substantially remove formation fines from the viscous hydrocarbonaceous fluid.

Production from the well is ceased and a second volume of steam is injected into the well. The well is again produced and substantially solids free hydrocarbonaceous fluids are removed from the lower formation interval due to the filter screen at the fracture face.

Cyclic steam-injection and oil production are continued until it is uneconomical to remove additional solids free hydrocarbonaceous fluids from the formation.

Once it has become uneconomical to produce additional substantially solids free hydrocarbonaceous fluids from the lower interval, the produced zone is isolated, another interval is fractured hydraulically, the fracture propped, and cyclic steam-injection/oil production commenced until it becomes uneconomical to produce this interval. This sequence can be repeated until the desired amount of solids free hydrocarbonaceous fluids have been removed from the desired productive intervals of the formation adjacent to the wellbore.

It is therefore an object of this invention to form a thermally stable in situ formation fines screen so as to filter fines from the produced oil.

It is another object of this invention to provide for a method to thoroughly treat a formation surrounding a well with high temperature steam.

It is yet another object of this invention to provide for an oscillatory steam treatment procedure in a well so as to provide for a more efficient sweep of the payzone with steam.

DESCRIPTION OF THE PREFERRED EMBODIMENTS

In the practice of this invention a well is drilled into a formation. The well is cased and then selectively perforated over a one to two foot interval in the lower productive interval of the formation. Due to the shallow depth of the tar sand or other viscous hydrocarbonaceous containing formation, the nature of the soft formation rock makes it more probable that horizontal fractures will be produced in the formation during hydraulic fracturing. A hydraulic fracturing technique is discussed in U.S. Pat. No. 4,067,389 which issued to Savins on Jan. 10, 1978. Another method for initiating hydraulic fracturing is disclosed by Medlin et al. in U.S. Pat. No. 4,378,849 which issued on Apr. 5, 1983. Both patents are hereby incorporated by reference herein. As is known by those skilled in the art, in order to initiate hydraulic fracturing in a formation, the hydraulic pressure applied must exceed the formation pressures in order to cause a fracture to form. The fracture which forms will generally run perpendicular to the least principle stress in the formation or reservoir.

The fracturing fluid which is used to hydraulically fracture the formation comprises a viscous gel. The viscous gel can include a water-base hydroxypropyl guar (HPG), hydroxyethyl cellulose (HEC), carboxymethylhydroxyethyl cellulose (CMHEC), guar or oil-based diesel oil, and kerosene gelled with aluminum phosphate esters (e.g., Halliburtron Services MY-T Oil TM II, Dowell/Schlumberger's YF-GO TM B. J. Titan's ALLOFRAC TM, and The Western Company of North America's MAXI-O TM Gel).

The proppant concentration in the viscous gel should be in concentration of about 10 to about 18 pounds/gallons and can include a silicon carbide, silicon nitride or garnet proppant. These proppants are particularly preferred since they endure the high temperature effects of steam. A hydraulic fracturing method employing special sand control is disclosed by Stowe et al. in U.S. Pat. No. 4,549,608 which issued on Oct. 29, 1985. This patent is hereby incorporated by reference herein. Silicon carbide or silicon nitride which can be used herein should be of a size of from about 20 to about 100 U.S. Sieve. This fused material should have a Mohs hardness of about 9. Both silicon carbide and silicon nitride have excellent thermal conductivity. Silicon nitride, for example, has a thermal conductivity of about 10.83 BTU-/in sq. ft/hr./° F. at 400 to about 2,400° F. A suitable silicon carbide material is sold under the Crystolon ® trademark and can be purchased from Norton Company, Metals Division, Newton, Mass. A suitable silicon nitride material can be also purchased from Norton Company. The size of the proppant used herein should be based on the particle size distribution of the formation fines so as to restrict formation fines movement into the propped fracture by the formation of a fines screen.

Figure 1:
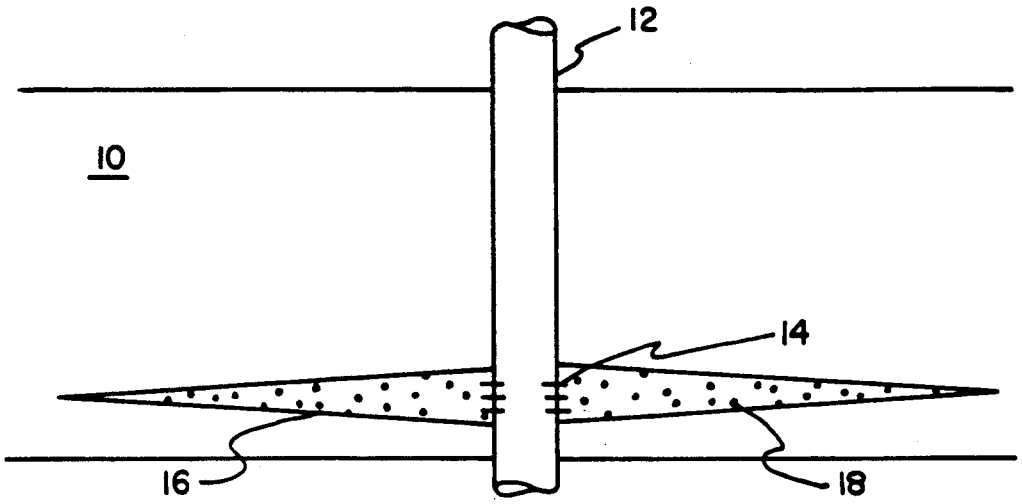
FIG. 1 is a schematic representation of a well showing a fracture in the formation, which fracture has a fluid and proppant therein.
Figure 2:
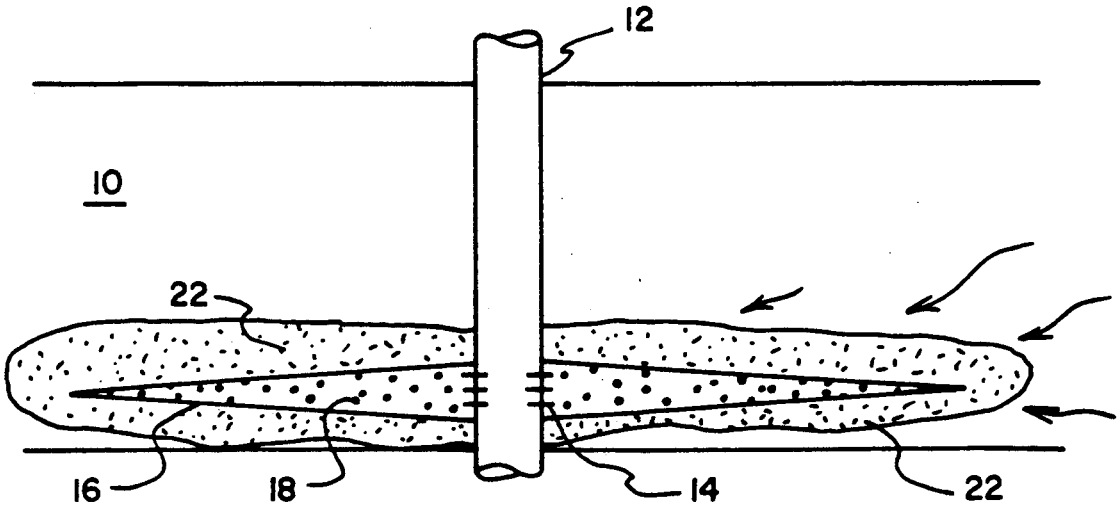
FIG. 2 is a schematic representation which shows a well penetrating a formation where said formation has been fractured and the fracture propped with a fracturing fluid containing a proppant sufficient to form a fines screen at the face of the fracture.

As is shown in FIG. 1, proppant 18 has entered fracture 16 in formation 10 via perforations 14. The well is fractured at a lower interval of formation 10. After fracturing the well, a pre-determined volume of steam is injected into the well 12 where it enters fracture 16 to soften tar sand and reduce the viscosity of oil adjacent to the fracture face. After injecting steam into well 12 for a desired period of time, well 12 is shut in and carefully produced to allow formation fines 22 to build up on the resulting fracture face as shown schematically in FIG. 2. As in shown in FIG. 2, fines 22 continue to build up so as to make a filter screen which filters formation fines from the produced oil. A second volume of steam is then injected into well 12 and it is then opened to production again. Steam injection is again commenced into well 12, the well shut in, and subsequently produced again. The cycle of injection and production is repeated until it is no longer desirable or economically feasible to produce hydrocarbonaceous fluids from the lower interval.

Figure 3:
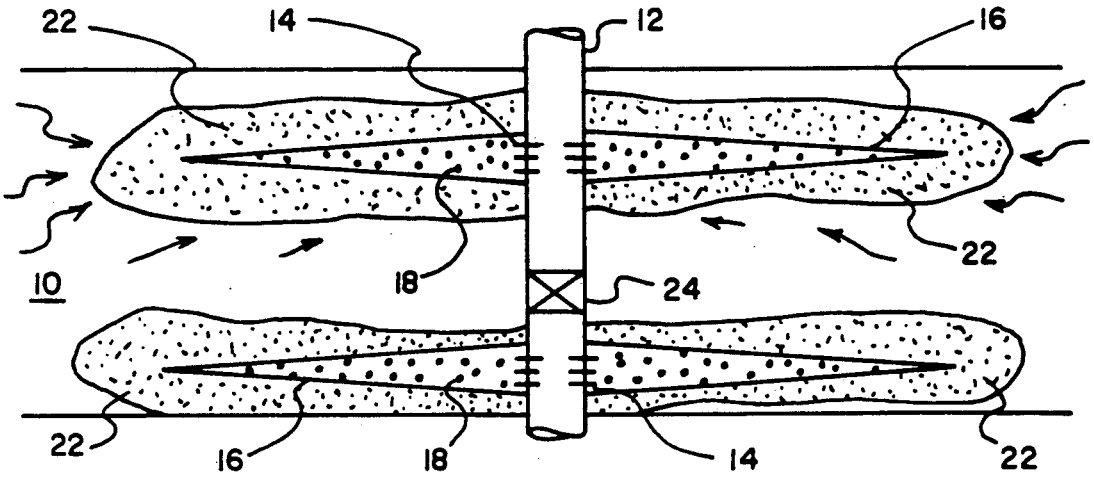
FIG. 3 is a schematic representation which shows the isolation of a formation's lower level and an upper interval containing a fracture that is propped with a proppant of a size sufficient to form a fines screen at the fracture's face.

Once it has become uneconomical or undesirable to produce the lower interval, the lower zone is isolated with squeeze cementing or with a cast iron bridge plug. An upper interval is then perforated and fractured as was done in the lower interval as is shown in FIG. 3. Steam injection is directed into the upper interval through perforations 14 for a time sufficient to soften the viscous fluids and the interval is carefully produced to allow formation fines to build up on the fracture face. The steps as followed in producing the lower formation are repeated until it is no longer desirable or economically feasible to produce hydrocarbonaceous fluids from the upper interval. When this occurs, the upper interval is isolated and the sequence of steps are again repeated. After this upper interval is depleted of hydrocarbonaceous fluids, it can be isolated and another interval similarly treated. Utilization of this method allows for thorough steam treatment of the productive intervals surrounding the wellbore.

Although in one embodiment a lower productive interval has been fractured, propped, steam treated and produced, an upper interval can be similarly treated and then a lower interval. The order in which the productive intervals are treated is unimportant so long as the treated interval is isolated prior to commencement of treatment in another interval.

Although the present invention has been described with preferred embodiments, it is to be understood that modifications and variations may be resorted to without departing from the spirit and scope of this invention, as those skilled in the art will readily understand. Such modifications and variations are considered to be within the purview and scope of the appended claims.

What is claimed is:

1. A method for producing viscous substantially fines-free hydrocarbonaceous fluids from an unconsolidated or loosely consolidated formation comprising:

(a) drilling into said formation at least one well into a first productive interval of said formation;

(b) fracturing hydraulically said well with a viscous fracturing fluid containing a proppant therein which is of a size sufficient to prop a created fracture and restrict fines movement into the fracture which proppant comprises silicon carbide, silicon nitride, or garnet;

(c) injecting a pre-determined volume of steam into said well in an amount sufficient to soften said viscous fluid and lower the viscosity of said fluid adjacent a fracture face;

(d) producing the well at a rate sufficient to allow formation fines to build up on a fracture face communicating with said well thereby resulting in a filter screen sufficient to substantially remove formation fines from the hydrocarbonaceous fluids;

(e) injecting a second volume of steam into said well and producing substantially fines free hydrocarbonaceous fluids to the surface;

(f) repeating steps (c) through (e) until a desired amount of hydrocarbonaceous fluids have been produced from said first interval; and (g) isolating mechanically said first interval and repeating steps (a) through (f) in a second productive interval of said formation.

2. The method as recited in claim 1 where said mechanical isolation is by squeeze cementing or via a bridge plug.

3. The method as recited in claim 1 where the well is cased and selectively perforated at a one to two foot interval so as to communicate fluidly with a productive interval of the formation.

4. The method as recited in claim 1 where the unconsolidated formation comprises tar sand.

5. The method as recited in claim 1 where in step (b) the proppant size is determined by the particle size distribution of formation fines so as to restrict fines movement into a propped fracture.

6. The method as recited in claim 1 where steps (a) through (g) are repeated until a desired number of productive intervals have been produced.

* * * * *